US006346147B1

(12) United States Patent
Rinehart et al.

(10) Patent No.: US 6,346,147 B1
(45) Date of Patent: Feb. 12, 2002

(54) DIMPLE PATTERN GLUE ROLLER

(75) Inventors: Steven R. Rinehart, Chesterfield; Steven M. Campbell, Mechanicsville, both of VA (US)

(73) Assignee: Philip Morris Incorporated, New York, NY (US)

( * ) Notice: Subject to any disclaimer, the term of this patent is extended or adjusted under 35 U.S.C. 154(b) by 0 days.

(21) Appl. No.: 09/399,259

(22) Filed: Sep. 20, 1999

(51) Int. Cl.[7] ..... B05C 1/02

(52) U.S. Cl. ..... 118/211; 118/212; 156/578; 492/30; 492/36

(58) Field of Search ..... 118/211, 212, 118/249, 261; 156/291, 578; 492/30, 36; 131/284, 106

(56) References Cited

U.S. PATENT DOCUMENTS 2,787,244 A * 4/1957 Hickin ..... 118/212
4,594,962 A * 6/1986 Focke ..... 118/212
5,895,553 A * 4/1999 Spada ..... 118/211
6,098,691 A * 8/2000 Boldrini ..... 118/261

* cited by examiner

*Primary Examiner*—Laura Edwards
(74) *Attorney, Agent, or Firm*—Connolly Bove Lodge & Hutz LLP

(57) ABSTRACT

A dimple pattern glue roller functions to apply glue to the closure flaps of a partially assembled cigarette pack. The roller has an outer cylindrical surface, and a pattern of dimpled recesses in the cylindrical surface receive glue and apply that glue to the closure flaps prior to folding the closure flaps against the assembled cigarette pack. The glue is applied in an efficient and economical manner, and substantially less glue is required when compared to existing glue applicator constructions.

7 Claims, 3 Drawing Sheets

DIMPLE PATTERN GLUE ROLLER

BACKGROUND OF THE INVENTION

The present invention relates to a glue roller for applying glue to the closure flaps of a cigarette pack, and more particularly to a dimple pattern glue roller that applies glue to such closure flaps in an efficient and economical manner.

High speed production procedures are used for folding and assembling cigarette pack blanks into finished cigarette packs. During these procedures, the cigarette pack blanks are partially folded into shape and glue is applied to outwardly extended closure flaps prior to folding the flaps against the assembled pack. It is important that the glue be applied in an efficient and economical manner, and also that the glue be applied in a manner that enables clean operation of the packer machines. The prior art fails to achieve these overall objectives.

SUMMARY OF THE INVENTION

Accordingly, one of the objects of the present invention is a dimple pattern glue roller that applies glue to the closure flaps of cigarette packs in a highly efficient and economical manner.

Another object of the present invention is a dimple pattern glue roller that uses substantially less glue when compared to existing glue applicators presently employed in the assembly of cigarette packs.

Another object of the present invention is a dimple pattern glue roller that applies a cleaner pattern of glue which results in an overall cleaner operation.

In accordance with the present invention, a dimple pattern glue roller applies glue to the closure flaps of partially assembled cigarette packs. The roller has an outer cylindrical surface, and a pattern of dimpled recesses are provided in the cylindrical surface for receiving glue and applying that glue to the closure flaps.

Preferably, the pattern of dimpled recesses in the cylindrical surface includes two pattern repeats so that for each revolution of each pair of the glue rollers two cigarette packs are processed. Also, each dimpled recess may have a diameter of approximately 1.48 to 1.50 mm, and a depth of 0.32 to 0.36 mm, preferably 0.34 mm.

The pattern of dimpled recesses may include three equally spaced apart lines of dimpled recesses parallel to one another along circumferential lines on the outer cylindrical surface of the roller. Two of the lines are positioned close to the outer edges of the cylindrical surface, one on each side, and the other line is centrally located on the cylindrical surface.

In one embodiment of the present invention, the dimpled recesses of each of the three lines are equally spaced apart. Also, two additional lines of dimpled recesses may be positioned between the three equally spaced apart lines, one additional line on each side of the centrally located line on the cylindrical surface of the roller. The spacing between the dimpled recesses of the two additional lines may be substantially more than the spacing between the dimpled recesses of the three lines.

In another embodiment of the invention the dimpled recesses of the two lines positioned close to the outer edges of cylindrical surface are equally spaced apart while the dimpled recesses on the central line are equally spaced apart with substantially more spacing than the spacing between the dimpled recesses on the other two lines.

BRIEF DESCRIPTION OF THE DRAWINGS

Novel features and advantages of the present invention in addition to those mentioned above will become apparent to persons of ordinary skill in the art from a reading of the following detailed description in conjunction with the accompanying drawing wherein similar reference characters refer to similar parts and in which.

DETAILED DESCRIPTION OF THE INVENTION

Figure 1:
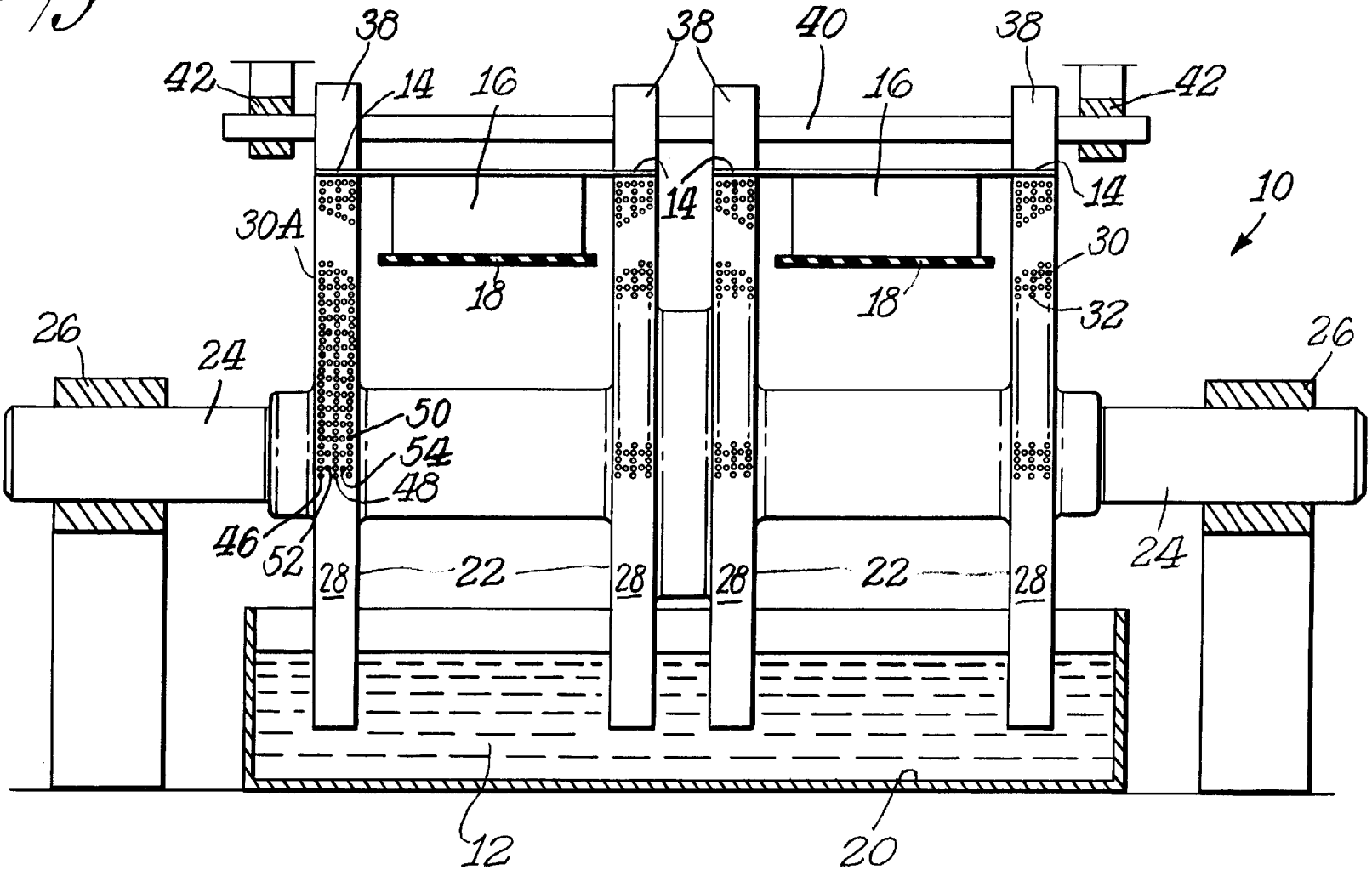
FIG. 1 is a schematic front elevational view showing two partially folded cigarette packs with glue being applied to the closure flaps thereof using dimple pattern glue rollers, according to he present invention.

Referring in more particularity to the drawings, FIG. 1 schematically shows a packer 10 for applying glue 12 to the closure flaps 14 of a partial assembled cigarette pack 16. In this particular operation, a flat cigarette pack blank (not shown) is partially folded into its box-like shape with the closure flaps 14 extending outwardly of the box-like configuration. A conveyor 18 delivers the partially assembled cigarette packs to a glue station where glue 12 from a glue reservoir 20 is applied to the closure flaps.

Glue rollers 22 are used to apply glue 12 to the closure flaps 14 as the partially assembled cigarette packs 16 are conveyed through the glue station. As schematically shown in FIG. 1, four glue rollers are mounted for rotation on a central shaft 24 journaled in bearings 26. Shaft 24 is driven by a suitable drive (not shown). The pair of rollers 22 on the right side of FIG. 1 process one conveyor line of cigarette packs while the pair of rollers to the left process a second line of cigarette packs.

As explained more fully below, each glue roller 22 has an outer cylindrical surface 28, and a pattern 30 of dimpled recesses 32 is arranged on the cylindrical surface for receiving glue 12 and applying that glue to the closure flap 14 of the cigarette pack 16.

Figure 2:
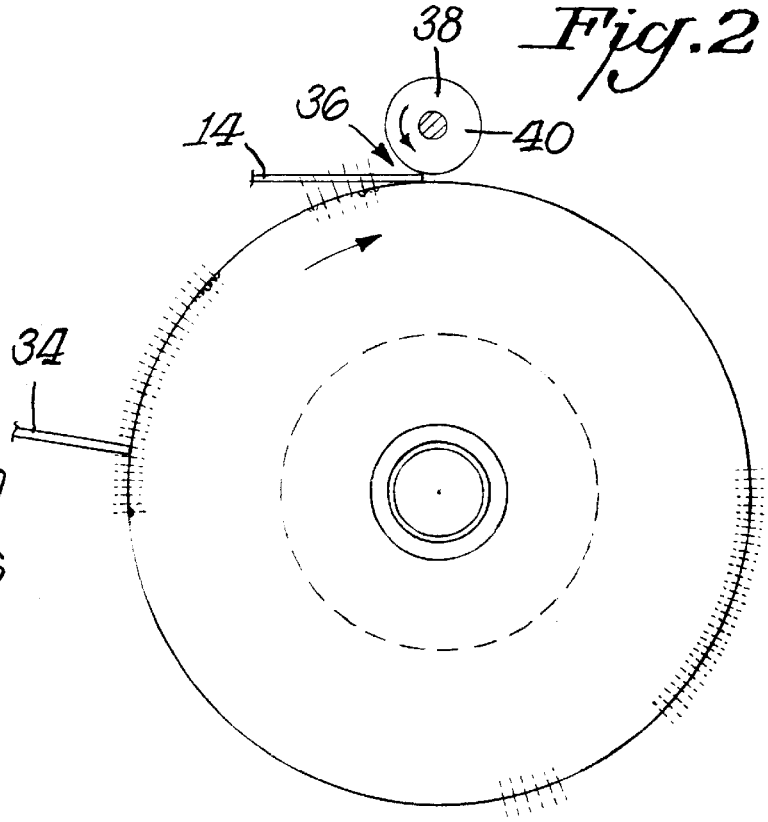
FIG. 2 is a side elevational view of one of the dimple pattern glue rollers showing the center lines for the dimpled recesses of the pattern, according to the present invention.

As shown best in FIGS. 1 and 2, as the glue rollers travel through reservoir 20, glue is coated onto the cylindrical surface 28 of each roller. A scraper 34 adjacent each roller functions to remove excess glue so that the only glue remaining on the roller is located in the dimpled recesses 32. The dimple pattern allows for cleaner scraping of the cylindrical face of the glue roller and also prolongs the life of the scraper as a result of very little abrasion between the scraper and the glue roller. A roller nip 36 is formed between each of the glue rollers 22 and complimentary pinch rollers 38. The pinch rollers are secured to shaft 40 which is journaled to bearings 42. As each enclosure flap 14 travels through the roller nip 36, glue from rollers 22 is transferred to the flaps. Subsequently the flaps are folded against the partially assembled cigarette pack to complete the assembly operation.

As shown best in FIG. 2, the pattern 30 of dimpled recesses 32 in the cylindrical surface 28 of each glue roller 22 includes two pattern repeats 30 ,30. The spacing between the partially assembled cigarette pack 16 on conveyor 18 is such that for each complete revolution of a pair of the glue rollers 22 two cigarette packs are processed.

Figure 4:
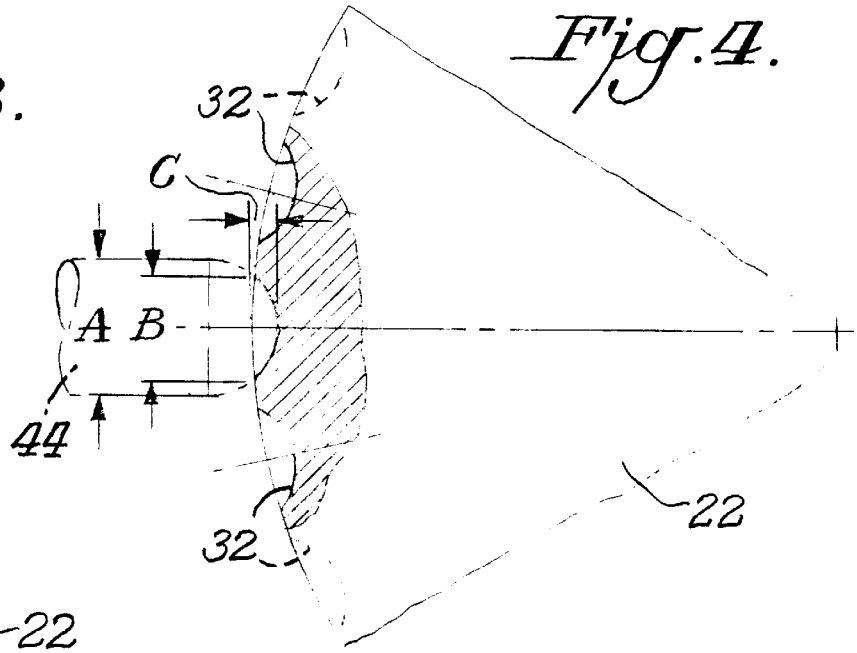
FIG. 4 is an enlarged fragmental side elevational view of the dimple pattern glue roller showing dimensional details of the dimpled recesses.

FIG. 4 illustrates the dimensional details of the dimpled recesses 32. Preferably, each dimpled recess has a diameter B of 1.48 to 1.50 mm and a depth C of 0.32 to 0.36 mm. Preferably, each dimpled recess 30 is made by a ball end mill 44 having a diameter A of 2 mm. The ball end mill 44 may be plunged to a depth C of 0.34 millimeters and this results in obtaining a recess diameter B of approximately 1.48 to 1.50 mm. These are the preferred dimensions of the dimpled recesses.

One pattern 30A of dimpled recesses 32 is shown in FIG. 1. This pattern includes three equally spaced apart lines 46, 48 and 50 of dimpled recesses parallel to one another along circumferential lines on cylindrical surface 28 of each roller 22. Lines 46 and 50 are positioned on the outside edges of the cylindrical surface 28 while line 48 is centrally located on the cylindrical surface. The dimpled recesses 32 of each line are equally spaced apart. Two additional lines 52, 54 of dimpled recesses are positioned between the three equally spaced apart lines 46, 48 and 50 with one additional line on each side of centrally located line 48. The dimpled recesses 32 of each of the two additional lines 52, 54 are equally spaced apart by the same amount but this amount of spacing is substantially more than the spacing between the dimpled recesses of the lines 46, 48 and 50, as shown in FIG. 1.

Figure 3:
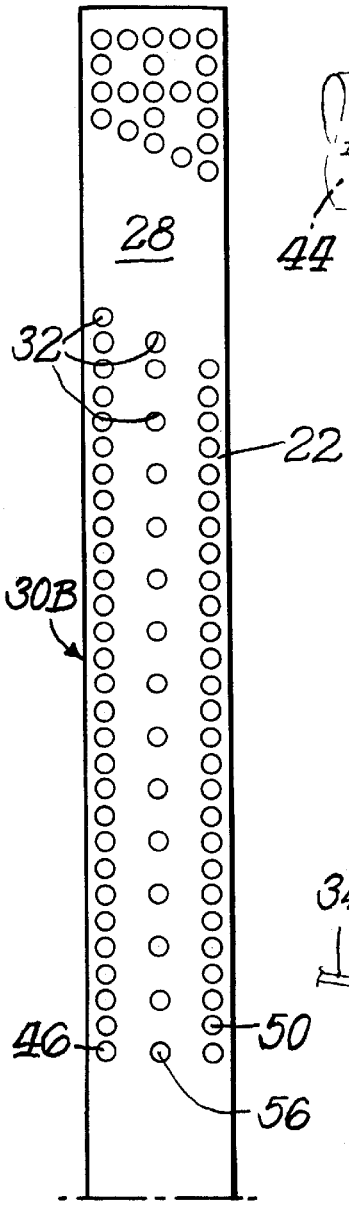
FIG. 3 is a fragmental front view of another dimple pattern glue roller having a different pattern of dimpled recesses, according to the present invention.

Another pattern 30B of dimpled recesses 32 is shown in FIG. 3. Outside lines 46, 50 are the same as described above, but a central line 56 is different in that the spacing between the dimpled recesses 32 in line 56 are spaced apart substantially more than the spacing in lines 46, 50. Moreover, in the embodiment shown in FIG. 3 the two additional lines of dimpled recesses are not included.

Figure 5:
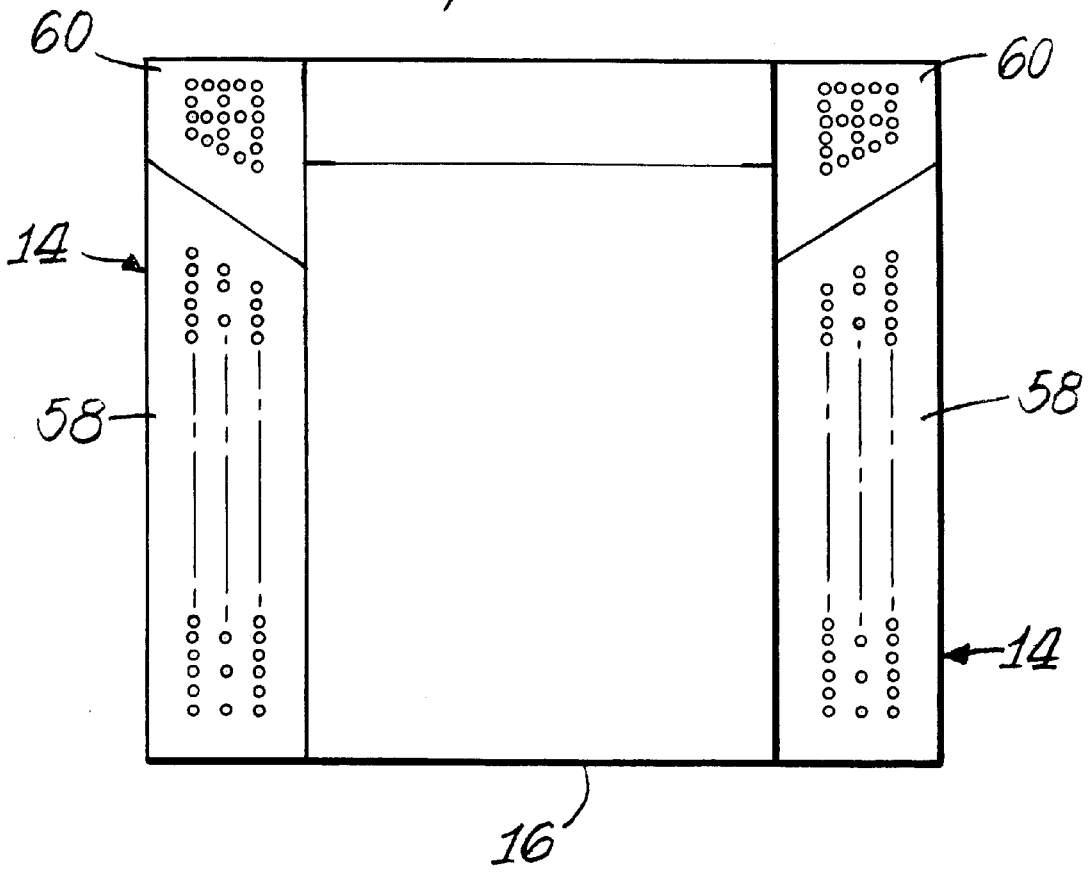
FIG. 5 is a rear elevational view of a partially closed cigarette pack showing the dimple pattern of glue applied to the closure flaps by the glue rollers shown in FIGS. 1–3.

FIG. 5 is a rear elevational view of a partially assembled cigarette pack 16 showing the dimple pattern 30 of glue 12 as applied by the glue rollers 22 to closure flaps 14. These closure flaps include flaps 58 for the body of the cigarette pack and flaps 60 for the hinged lid of the cigarette pack.

What is claimed is:

1. A dimple pattern glue roller for applying glue to closure flaps of partially assembled cigarette packs comprising a roller having an outer cylindrical surface, and a pattern of dimpled recesses on the cylindrical surface for receiving glue and applying that glue to the closure flaps, and wherein the pattern of dimpled recesses includes three equally spaced apart lines of dimpled recesses parallel to one another along circumferential lines of the outer cylindrical surface of the roller, two of the lines of dimpled recesses positioned on outer edge portions of the cylindrical surface, one on each outer edge portion, and the other line centrally located on the cylindrical surface.

2. A dimple pattern glue roller as in claim 1 wherein the dimpled recesses of each line are equally spaced apart by the same amount.

3. A dimple pattern glue roller as in claim 2 including two additional lines of dimpled recesses positioned between the three equally spaced apart lines, one additional line on each side of the centrally located line on the cylindrical surface of the roller.

4. A dimple pattern glue roller as in claim 3 wherein the dimpled recesses of each of the two additional lines are equally spaced apart by the same amount, and wherein the amount of spacing is substantially more than the spacing between the dimpled recesses of the three lines.

5. A dimple pattern glue roller as in claim 1 wherein the dimpled recesses of the two lines positioned on the outer edge portions of the cylindrical surface are equally spaced apart, and wherein the dimpled recesses of the central line are equally spaced apart substantially more than the spacing between the dimpled recesses of the other two lines.

6. A dimple pattern glue roller as in claim 1 wherein each dimpled recess has a diameter of approximately 1.48 to 1.50 mm and a depth of 0.32 to 0.36 mm.

7. A dimple pattern glue roller as in claim 6 wherein each dimpled recess has a depth of approximately 0.34 mm.

* * * * *